US011745500B2

(12) United States Patent
Tsuji et al.

(10) Patent No.: US 11,745,500 B2
(45) Date of Patent: Sep. 5, 2023

(54) INK HEATING DEVICE, INKJET RECORDING APPARATUS, INK SUPPLY APPARATUS, AND IMAGE FORMING SYSTEM

(71) Applicant: KYOCERA Document Solutions Inc., Osaka (JP)

(72) Inventors: Kikunosuke Tsuji, Osaka (JP); Masahiro Kashimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 30 days.

(21) Appl. No.: 17/583,391

(22) Filed: Jan. 25, 2022

(65) Prior Publication Data

US 2022/0234348 A1 Jul. 28, 2022

(30) Foreign Application Priority Data

Jan. 27, 2021 (JP) ..... 2021-011109

(51) Int. Cl.
*B41J 2/045* (2006.01)
*B41J 2/175* (2006.01)

(52) U.S. Cl.
CPC ..... *B41J 2/04531* (2013.01); *B41J 2/1752* (2013.01); *B41J 2/17513* (2013.01); *B41J 2/17596* (2013.01)

(58) Field of Classification Search
CPC .... B41J 2/04531; B41J 2/175; B41J 2/17503; B41J 2/17506; B41J 2/17509; B41J 2/17513; B41J 2/1752; B41J 2/17523; B41J 2/17553; B41J 2/17596; B41J 29/13; B41J 29/377; B41J 2002/17516
See application file for complete search history.

(56) References Cited

U.S. PATENT DOCUMENTS 9,527,286 B2 * 12/2016 Sakata ..... B41J 2/155
2007/0229611 A1 * 10/2007 Nagashima ..... B41J 2/17563 347/84

FOREIGN PATENT DOCUMENTS

JP 2018-140503 9/2018

* cited by examiner

*Primary Examiner* — Anh T Vo
(74) *Attorney, Agent, or Firm* — LEX IP MEISTER, PLLC

(57) ABSTRACT

An ink heating device comprising an ink container that includes an ink pack filled with ink, and a case housing the ink pack and having a first opening and a second opening, and a blower that sends warm air into the case through the first opening. The warm air is discharged through the second opening.

12 Claims, 13 Drawing Sheets

INK HEATING DEVICE, INKJET RECORDING APPARATUS, INK SUPPLY APPARATUS, AND IMAGE FORMING SYSTEM

This application is based upon and claims the benefit of priority from the corresponding Japanese Patent Application No. 2021-011109 filed on Jan. 27, 2021, the entire contents of which are incorporated herein by reference.

BACKGROUND

The present disclosure relates to an ink heating device, an inkjet recording apparatus, an ink supply apparatus, and an image forming system.

The inkjet recording apparatus includes a detachable ink container. The ink container includes an ink pack filled with ink and a case that houses the ink pack. The ink pack is formed in a bag shape using a film-like material, and includes a spout for supplying ink to the outside. The case includes a rectangular parallelepiped main body and an opening to which the spout is fixed.

SUMMARY

An ink heating device according to an embodiment of the present disclosure includes: an ink container including an ink pack filled with ink and a case housing the ink pack and having a first opening and a second opening and a blower that sends warm air into the case through one of the first opening and the second opening, and discharges the warm air through the other of the first opening and the second opening.

DETAILED DESCRIPTION

Hereinafter, a printer 1 (an inkjet recording apparatus) according to an embodiment of the present disclosure will be described with reference to the drawings.

Figure 1:
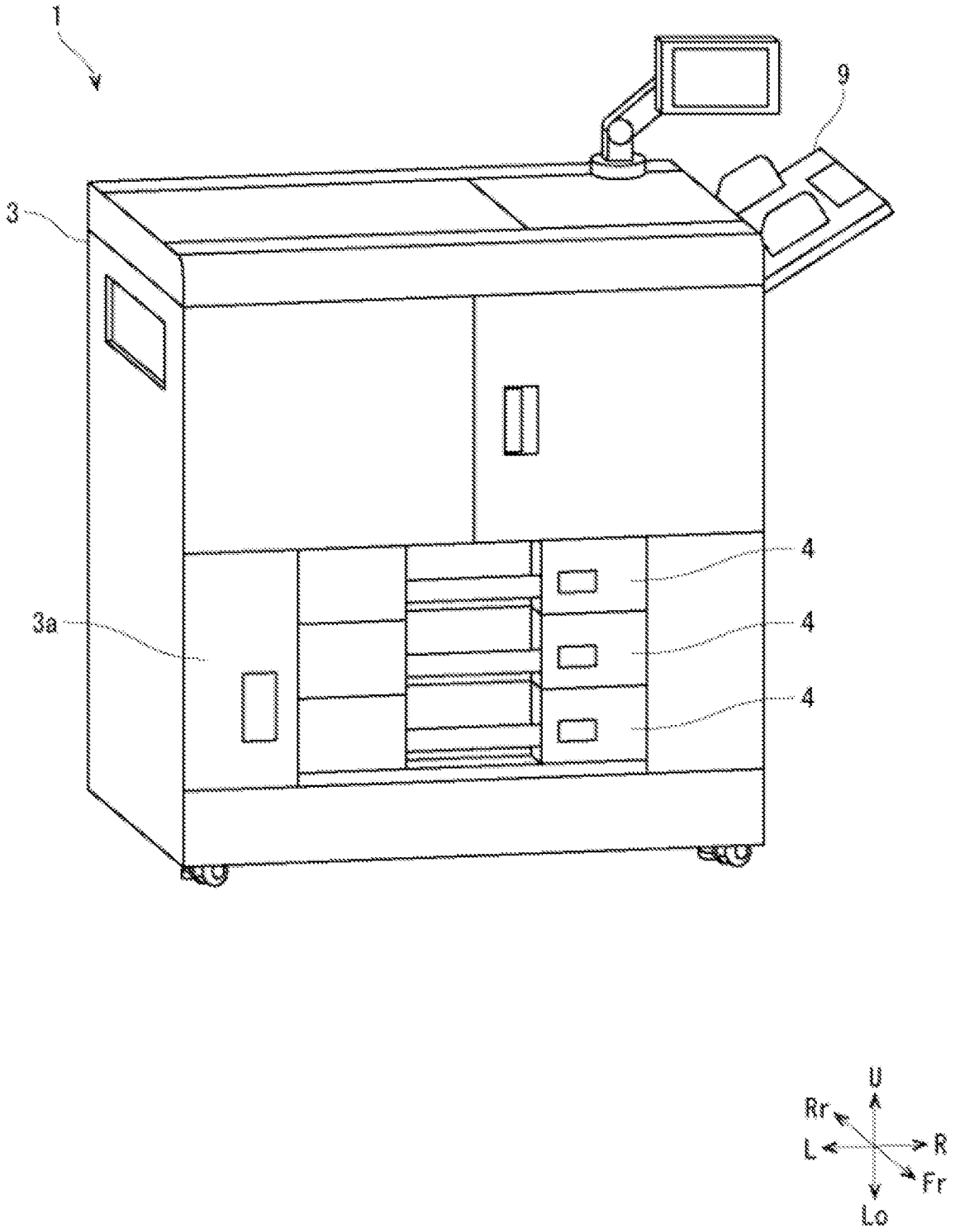
FIG. 1 is a perspective view illustrating an appearance of a printer according to an embodiment of the present disclosure.
Figure 2:
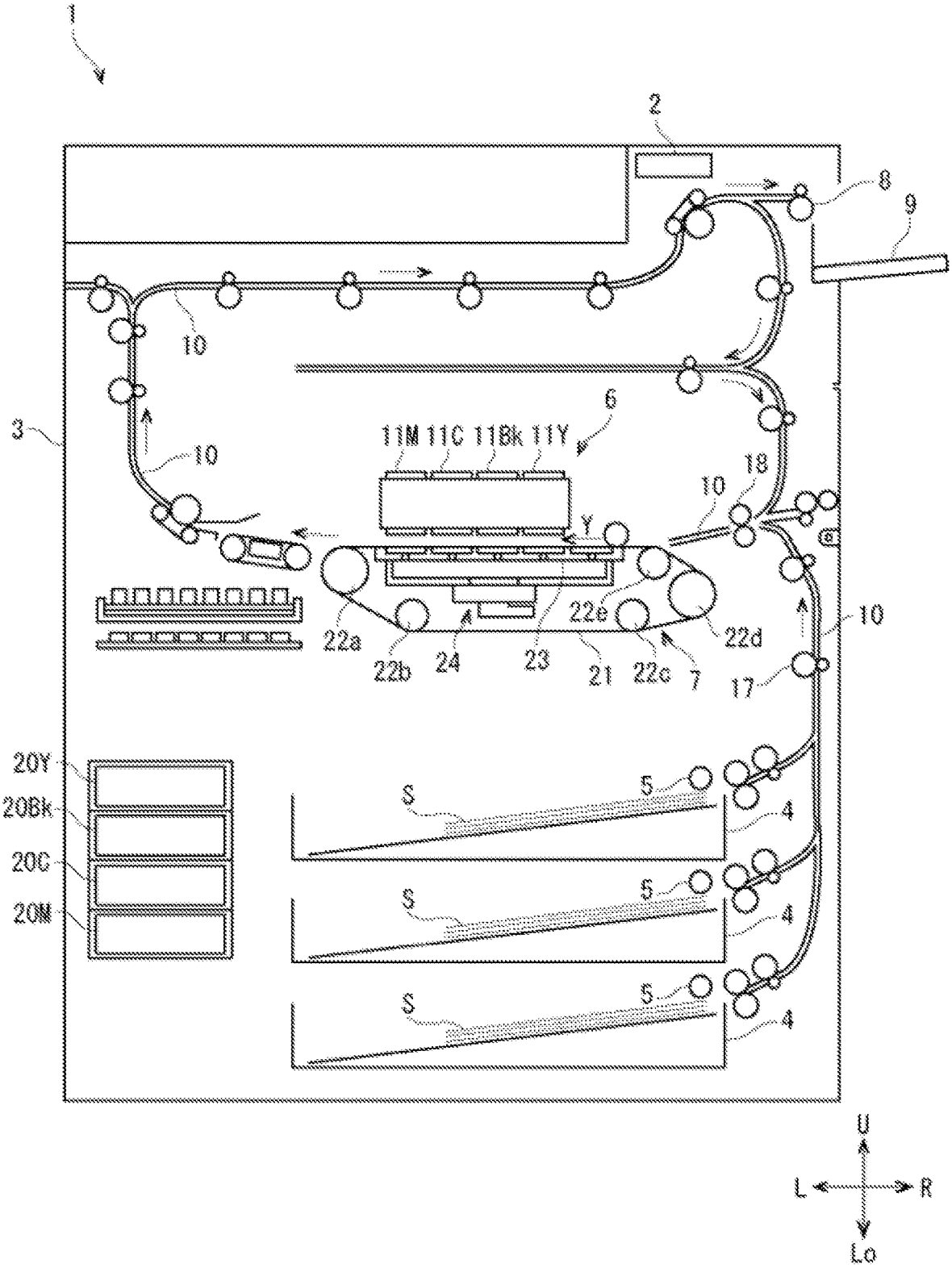
FIG. 2 is a front view schematically illustrating an internal configuration of a printer according to an embodiment of the present disclosure.
Figure 3:
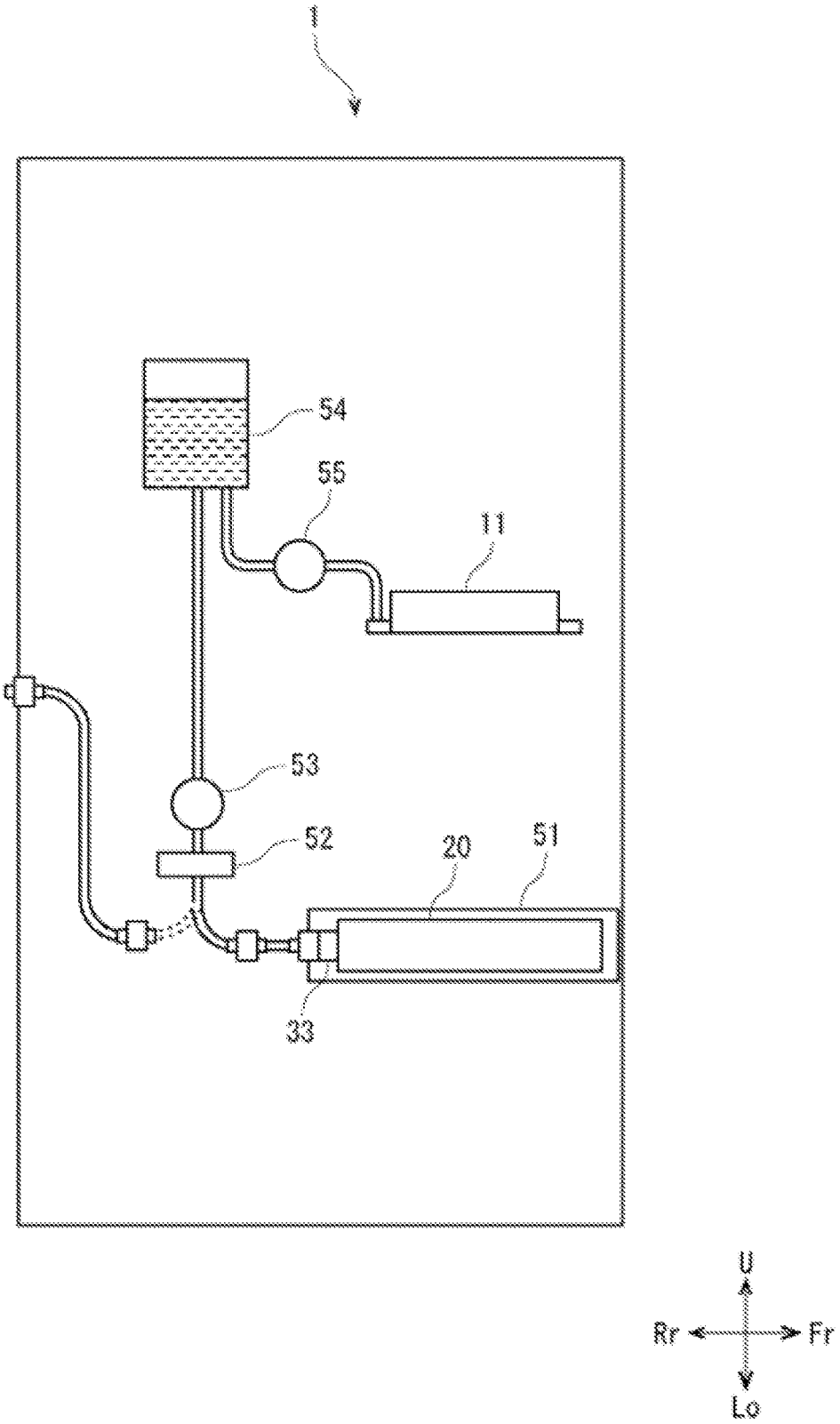
FIG. 3 is a diagram schematically illustrating an ink supply path according to an embodiment of the present disclosure.

First, the overall configuration of the printer 1 will be described. FIG. 1 is a perspective view showing an appearance of a printer 1. FIG. 2 is a front view schematically illustrating an internal configuration of the printer 1. FIG. 3 is a diagram schematically illustrating an ink supply path. Hereinafter, the front side of the paper in FIG. 2 will be referred to as the front side of the printer 1, and the left and right directions will be described based on the direction in which the printer 1 is viewed from the front side. In each figure, U, Lo, L, R, Fr, Rr indicates up, down, left, right, front, and back, respectively.

The printer 1 is an inkjet type image forming apparatus that forms an image by discharging ink. The printer 1 includes a main body housing 3 having a rectangular parallelepiped shape. In a lower interior portion of the main body housing 3, there are provided a sheet feeding cassette 4 in which sheet shaped paper S such as plain paper or coated paper is accommodated, and a sheet feeding roller 5 that feeds the sheet S from the sheet feeding cassette 4. A conveyance unit 7 that adsorbs and conveys the sheet S is provided above the sheet feeding cassette 4. An image forming unit 6 of an inkjet system is provided above the conveyance unit 7. A discharge roller pair 8 that discharges the sheet S on which an image has been formed and a discharge tray 9 on which the discharged sheet S is stacked are provided at an upper right portion of the main body housing 3.

The conveyance unit 7 includes an endless conveyance belt 21 provided with a large number of ventilation holes (not illustrated in the drawings) and wound around a plurality of rollers 22*a* to 22*e*, a conveyance plate 23 provided with a large number of ventilation holes and having an upper surface in contact with an inner surface of the conveyance belt 21, and a suction unit 24 that adsorbs air through the ventilation holes of the conveyance plate 23 to attract the sheet S to the conveyance belt 21. When the roller 22*a* is driven by a driving unit (not illustrated) such as a motor, the conveyance belt 21 rotates counterclockwise in FIG. 2, and the sheet S attracted to the conveyance belt 21 is conveyed in the Y direction.

The image forming unit 6 includes head units 11Y, 11Bk, 11C, 11M (collectively referred to as head units 11), and discharges yellow, black, cyan, and magenta inks, respectively. Ink containers 20Y, 20Bk, 20C, 20M (collectively referred to as ink containers 20) respectively filled with yellow, black, cyan, and magenta inks are connected to the head units 11Y, 11Bk, 11C, 11M.

The head unit 11 includes one or more inkjet heads, for example, a plurality of inkjet heads arranged in a staggered manner (not illustrated). The inkjet head includes a housing having a rectangular parallelepiped shape whose longitudinal direction is the front-rear direction, and a nozzle plate provided on a bottom portion of the housing. The nozzle plate includes a large number of nozzles arranged in the front-rear direction (the width direction of the conveyance belt 21 intersecting the conveyance direction of the conveyance belt 21), and discharge ports of the nozzles are provided on a lower surface (nozzle surface) of the nozzle plate. Each nozzle is provided with a piezoelectric element, and a drive circuit for driving the piezoelectric element is provided inside the housing.

The printer 1 includes an ink supply path shown in FIG. 3. In the drawing, a supply path corresponding to one color of ink is shown, but in the present embodiment, since four colors of ink are used, four systems of similar supply paths are provided. The printer 1 includes a container mounting portion 51 on which the ink container 20 is mounted, a filter 52 that filters ink, a pump 53 that sucks ink from the ink container 20 via the filter 52, a sub tank 54 that stores ink sent from the pump 53, and a pump 55 that supplies ink stored in the sub tank 54 to the head unit 11. The pump 55 is connected to a socket provided in the inkjet head.

A conveyance path 10 extending from the sheet feeding cassette 4 to the discharge tray 9 via the conveyance unit 7 is provided inside the main body housing 3. A plurality of conveyance roller pairs 17 for conveying the sheet S are provided in the conveyance path 10. A registration roller pair 18 is provided upstream of the image forming unit 6 in the conveying direction.

Each unit of the printer 1 is controlled by the controller 2. The controller 2 includes a processor and a memory. The processor may be, for example, a CPU (Central Processing Unit).

The memory includes a storage medium such as ROM (Read Only Memory), RAM (Random Access Memory) or EEPROM (Electrically Erasable Programmable Read Only Memory). The processor performs various processes by reading and executing the control program stored in the memory. The controller 2 may be realized by an integrated circuit that does not use software.

A basic image forming operation of the printer 1 is as follows. When an image forming job is input to the printer 1 from an external computer or the like, the sheet feeding roller 5 feeds the sheet S from the sheet feeding cassette 4 to the conveyance path 10, and the registration roller pair 18 whose rotation is stopped corrects the skew of the sheet S. When the registration roller pair 18 feeds the sheet S to the conveyance unit 7 at a predetermined timing, the conveyance unit 7 adsorbs the sheet S onto the conveyance belt 21 and conveys the sheet S in the Y direction. When the controller 2 supplies gradation data corresponding to each nozzle of the inkjet head to the drive circuit in synchronization with the conveyance of the sheet S, the drive circuit supplies a drive signal corresponding to the gradation data to the piezoelectric element, whereby ink droplets are discharged from the nozzle and an image is formed on the sheet S. The discharge roller pair 8 discharges the sheet S on which an image is formed to a discharge tray 9.

Figure 4:
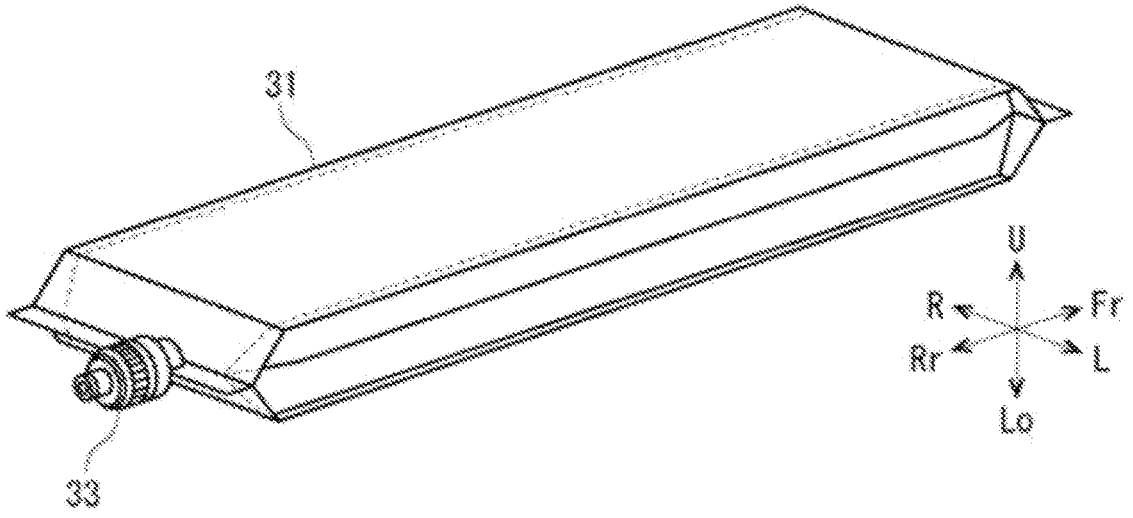
FIG. 4 is a perspective view of an ink pack according to an embodiment of the present disclosure.
Figure 5:
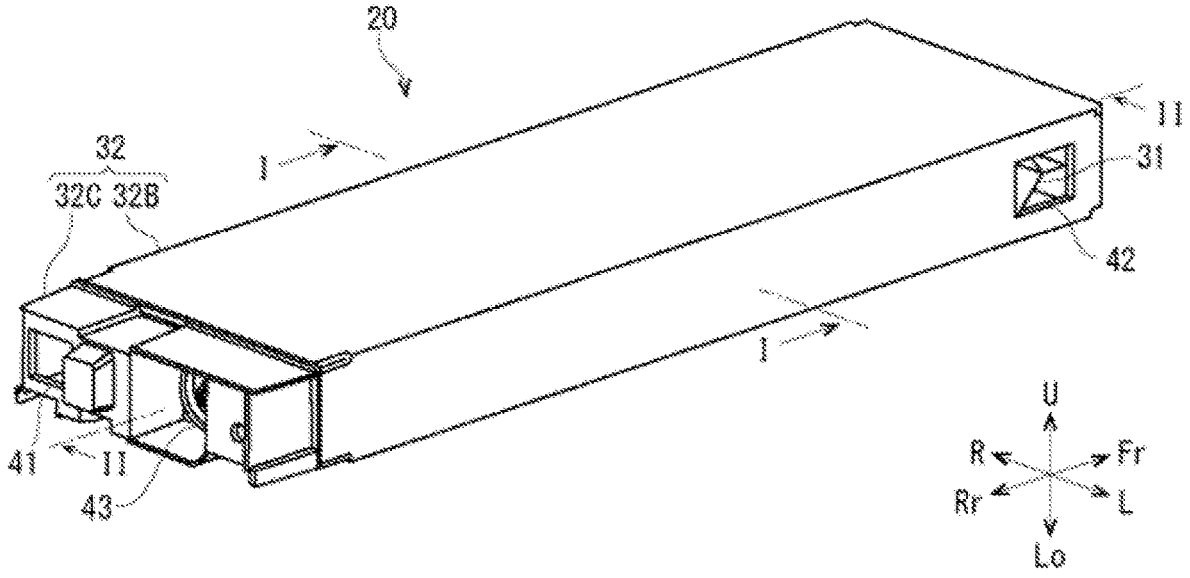
FIG. 5 is a perspective view of an ink container according to an embodiment of the present disclosure.
Figure 6:
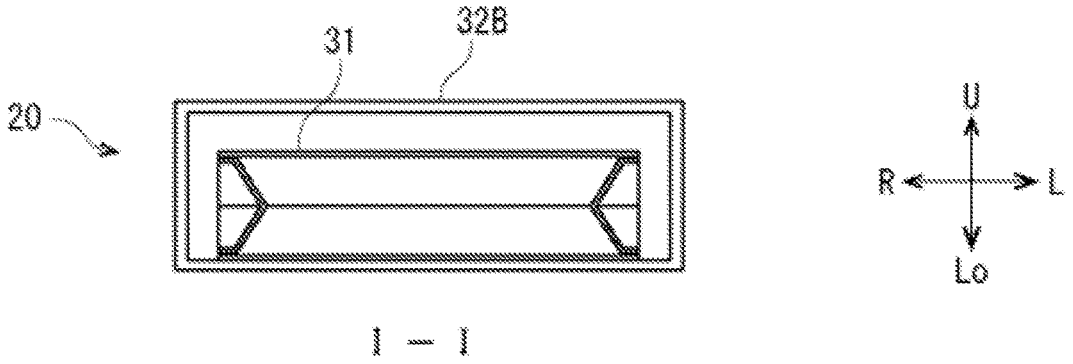
FIG. 6 is a sectional view taken along line I-I of the ink container shown in FIG. 5.
Figure 7:
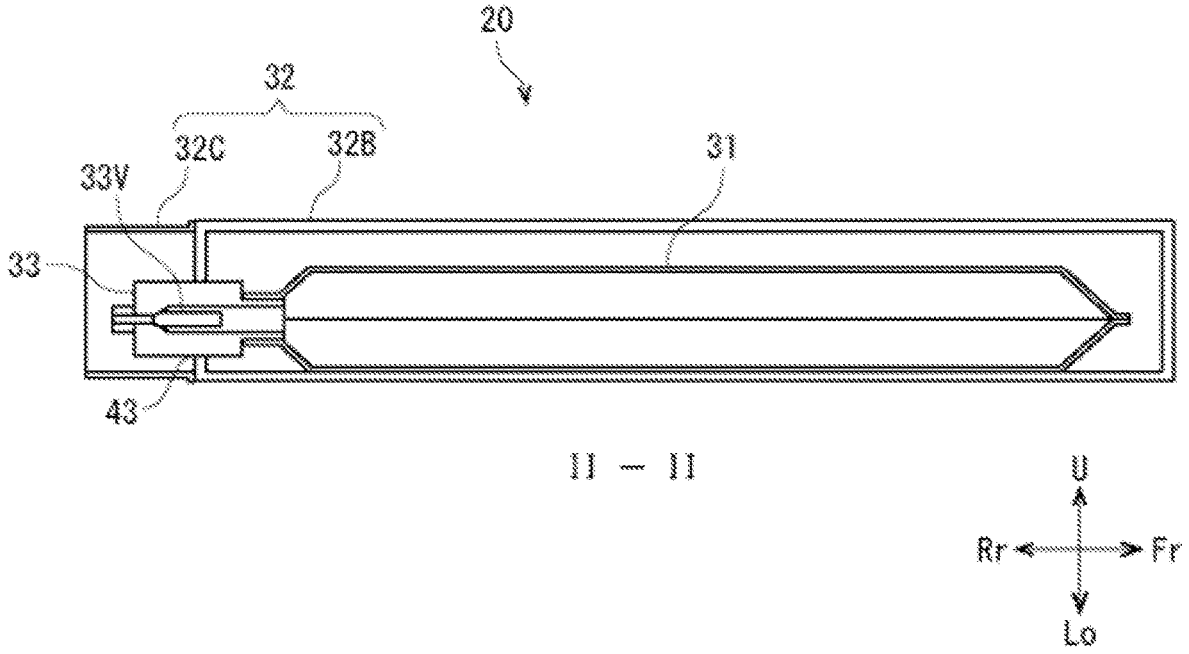
FIG. 7 is a sectional view taken along line II-II of the ink container shown in FIG. 5.
Figure 8:
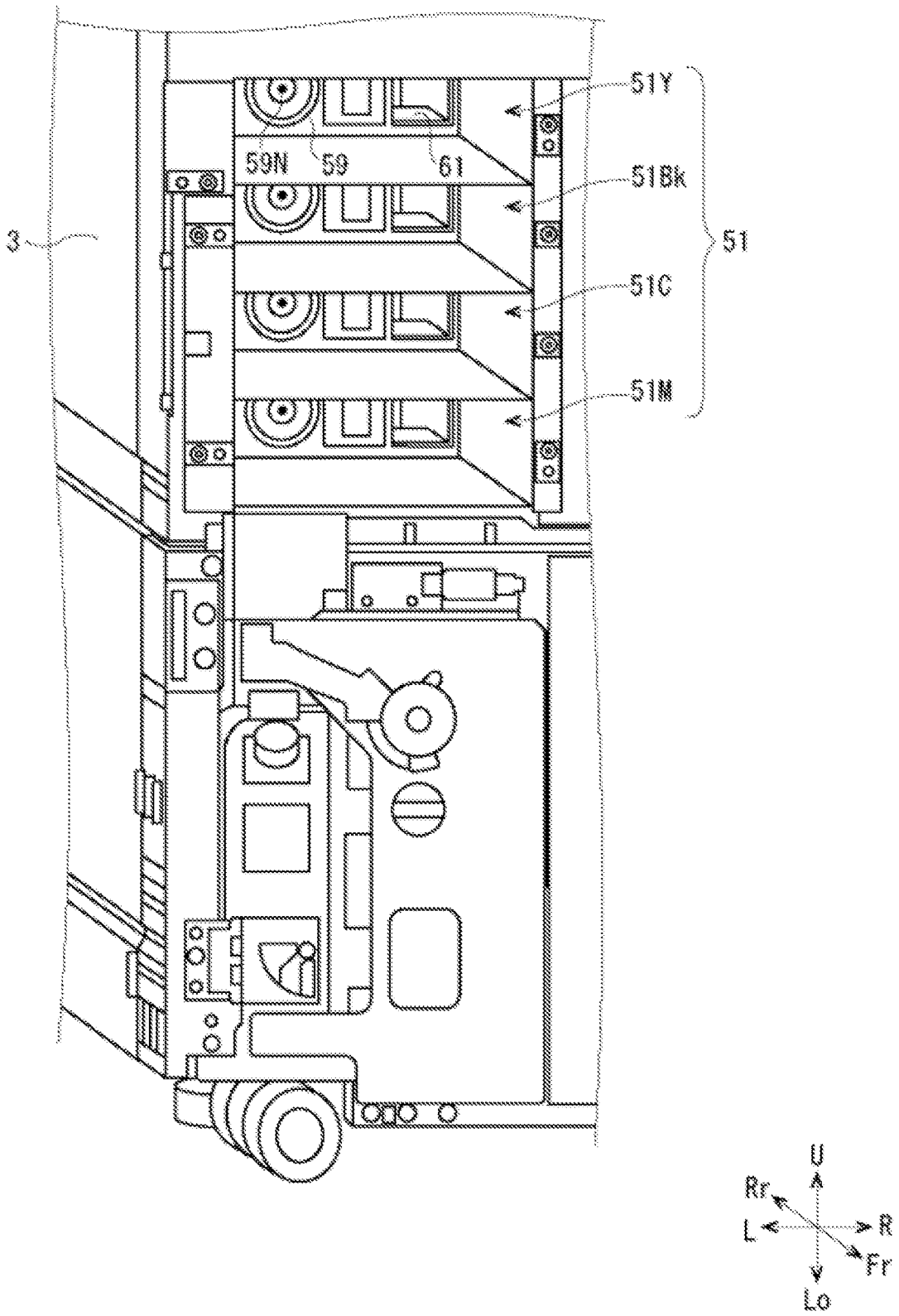
FIG. 8 is a perspective view of a container mounting portion according to an embodiment of the present disclosure.
Figure 9:
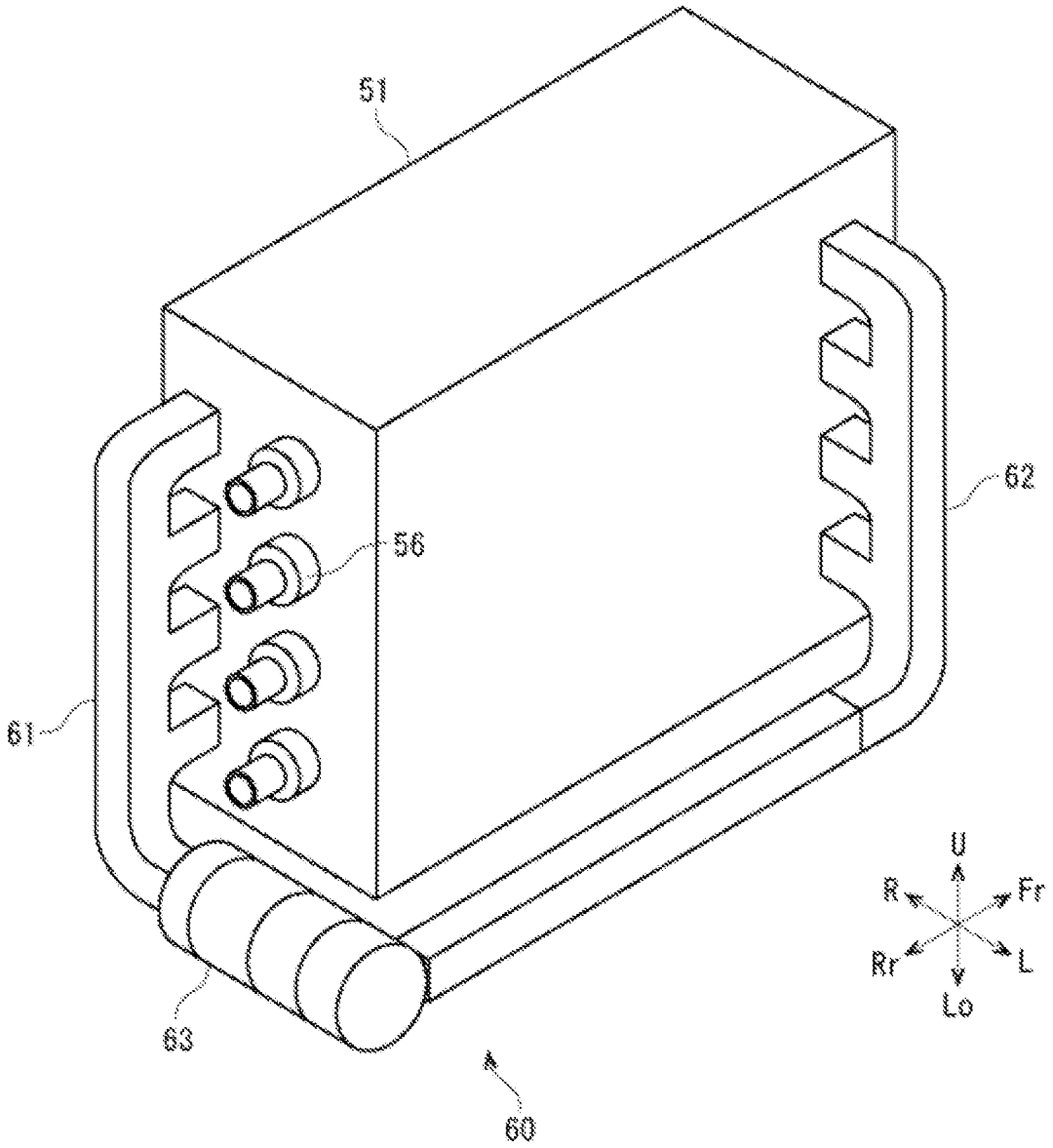
FIG. 9 is a perspective view of a container mounting portion according to an embodiment of the present disclosure.
Figure 10:
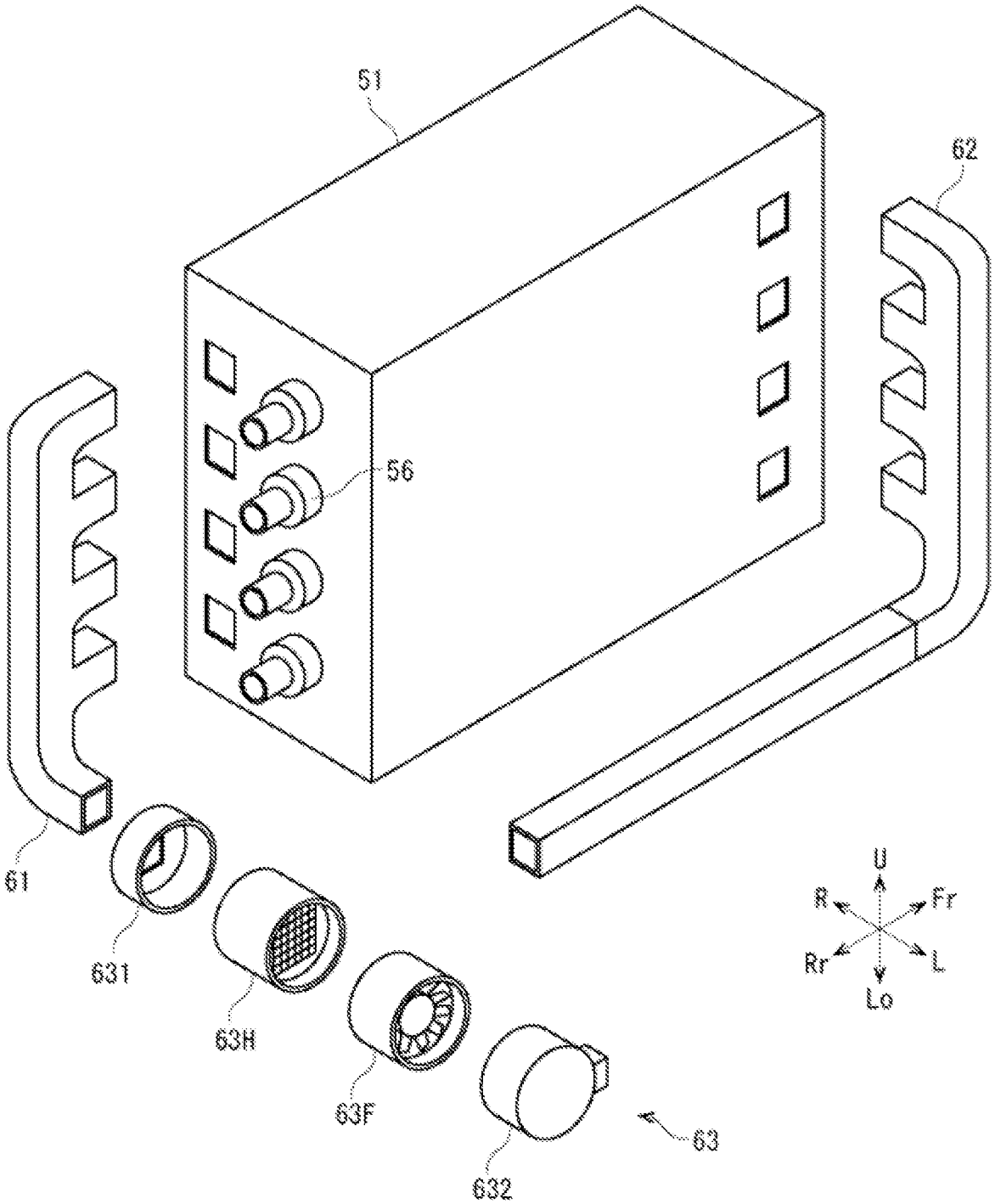
FIG. 10 is an exploded view of the container mounting portion.

Next, the ink heating device 60 will be described. FIG. 4 is a perspective view of an ink pack 31. FIG. 5 is a perspective view of the ink container 20. FIG. 6 is a sectional view taken along line I-I of the ink container 20 shown in FIG. 5. FIG. 7 is a sectional view taken along line II-II of the ink container 20 shown in FIG. 5. FIGS. 8 and 9 are perspective views of the container mounting portion 51. FIG. 10 is an exploded view of the container mounting portion 51.

The printer 1 includes the ink heating device 60 that heats ink, and an image forming unit 6 that forms an image by discharging ink supplied from the ink heating device 60. The ink heating device 60 includes an ink container 20 provided with an ink pack 31 filled with ink and a case 32 having a first opening 41 and a second opening 42 and housing the ink pack 31, and a blower 63 for sending warm air into the case 32 through one of the first opening 41 and the second opening 42, and the warm air is discharged through the other of the first opening 41 and the second opening 42. Although the present embodiment is an example in which the present disclosure is applied to the ink heating device 60 including four sets of the ink containers 20 and the container mounting portions 51, the present disclosure may be applied to the ink heating device 60 including one set, two sets, three sets, or five or more sets of the ink containers 20 and the container mounting portions 51.

[Ink Container]

The ink container 20 is attached to the container mounting portion 51 by being pushed in from the front side, and is detached from the container mounting portion 51 by being pulled out to the front side. Hereinafter, the mounting direction of the ink container 20 is a direction from the front to the rear.

[Ink Pack]

The ink pack 31 (see FIGS. 4, 6, and 7) is, for example, a container whose longitudinal direction is the front-rear direction, and is formed of a film in which resin and metal are laminated. Examples of the resin include polyamide, polyethylene terephthalate, and the like. The metal is, for example, aluminum. The ink pack 31 is formed by joining edges of a pair of upper and lower films and a pair of left and right films, and is formed in a gusseted bag shape. The joining of the films is performed by welding, adhesion, or the like. A spout 33 that supplies ink to the outside is provided at a rear end portion of the ink pack 31 (an example of an end portion on the far side in the mounting direction of the ink container 20 to the container mounting portion 51). The spout 33 is formed in a cylindrical shape, and is provided with a valve 33V that prevents outflow of ink when the ink container 20 is not attached to the container mounting portion 51.

[Case]

The case 32 (see FIGS. 5 to 7) is a box-shaped container whose dimensions in the up-down direction, the left-right direction, and the front-rear direction are larger than those of the ink pack 31. The case 32 includes a case main body portion 32B that occupies most of the case 32 in the front-rear direction, and a connecting portion 32C provided at a rear end portion (an end portion on the far side in the mounting direction) of the case main body portion 32B. The case main body portion 32B is formed of corrugated cardboard. The connecting portion 32C is made of resin. The rear end surface of the case main body portion 32B is open and is covered by the connecting portion 32C. That is, the connecting portion 32C forms an end surface on the far side in the mounting direction of the case 32. The ink pack 31 housed in the case 32 is in contact with the bottom portion of the case 32, and spaces through which air can flow are formed above, to the left, to the right, to the front, and to the rear of the ink pack 31.

The case 32 is formed in a rectangular parallelepiped shape whose longitudinal direction is the mounting direction, and includes a first opening 41, a second opening 42, and a third opening 43. The upper surface and the lower surface of the case 32 are two surfaces having the largest area among six surfaces forming a rectangular parallelepiped shape. The first opening 41 is provided on a first side surface (rear end surface in this example) of the four side surfaces of the case 32, the second opening 42 is provided on a second side surface (left side surface in this example) of the four side surfaces of the case 32, and the second opening 42 is provided at a position deviated to an end portion (front end portion in this example) having a longer distance from the first opening 41 among both end portions of the second side surface when the case 32 is viewed from above. Note that the position deviated to one end is a position where the distance from one end is shorter than the distance from the other end when the distances from both ends are compared.

To be specific, the first opening 41 and the third opening 43 are provided in the connecting portion 32C, that is, the rear end surface (an example of the end surface on the far side in the mounting direction) of the case 32. The spout 33 is fixed to the third opening 43. The second opening 42 is provided at a front end portion of the left side surface of the case 32 (an example of an end portion on the front side in the mounting direction of a side surface along the mounting direction). The first opening 41 is provided at a position deviated to the right side (an example of the side opposite to the side where the second opening 42 is provided) on the rear end surface of the case 32. Note that the second opening 42 may be provided on the right side surface of the case 32, and the first opening 41 may be provided on the left side of the rear end surface of the case 32.

It is desirable that the distance between the first opening 41 and the second opening 42 be long. Virtual lines from the first opening 41 to each part of the inner surface of the case 32 are considered, and a virtual line having the longest length among the virtual lines is set as a longest virtual line. The case 32 is divided into two parts of a first part and a second part on a virtual plane which passes through the middle point of the longest virtual line and which is orthogonal to the longest virtual line. Assuming that the first opening 41 is disposed in the first part, the second opening 42 is disposed in the second part. In this case, the distance between the first opening 41 and the second opening 42 can be increased.

The spout 33 may close the third opening 43. With this configuration, it is possible to reduce the possibility that the warm air entering through the first opening 41 flows out of the case 32 through any portion other than the second opening 42.

[Container Mounting Portion]

A container mounting portion 51Y, 51Bk, 51C, 51M (collectively referred to as container mounting portions 51) is provided at a lower left portion inside the main body housing 3 (see FIG. 8 to 10). An openable and closable container door 3*a* is provided at a lower left portion of a front surface of the main body housing 3. When the container door 3*a* is opened, the container mounting portion 51 is exposed, and the ink container 20 can be replaced. Ink containers 20Y, 20Bk, 20C, 20M are mounted on each of the container mounting portions 51Y, 51Bk, 51C, 51M.

"The container mounting portion 51 is formed in a box shape whose front side is open, and a connection port 59 to which the spout 33 of the ink container 20 is connected is provided in the rear portion thereof.

A needle 59N is provided at the center of the connection port 59. When the ink container 20 is mounted on the container mounting portion 51, the valve 33V of the spout 33 is pushed open by the needle 59N."

The container mounting portion 51 includes a first duct 61 connected to the blower 63. When the ink container 20 is attached to the container mounting portion 51, the first opening 41 faces the opening of the first duct 61. The first duct 61 guides warm air from the blower 63 to the container mounting portion 51. In addition, the container mounting portion 51 includes a second duct 62 connected to the blower 63, and when the ink container 20 is mounted on the container mounting portion 51, the second opening 42 faces an opening of the second duct 62. The second duct 62 guides the warm air discharged from the second opening 42 to the blower 63. The first duct 61 includes a branch pipe that guides warm air from the blower 63 to the plurality of ink containers 20, and the second duct 62 includes a collecting pipe that guides warm air discharged from the plurality of ink containers 20 to the blower 63. According to the above-described configuration, the warm air sent from the blower 63 passes through the first duct 61, the first opening 41, the inside of the case 32, the second opening 42, and the second duct 62 in this order, and returns to the blower 63. That is, the warm air circulates. The circulation direction of the warm air may be reversed.

[Blower]

The blower 63 includes a second duct connecting portion 632 to which the second duct 62 is connected, a fan 63F, a heater 63H, and a first duct connecting portion 631 to which the first duct 61 is connected. The fan 63F generates an airflow directed from the second duct connecting portion 632 to the first duct connecting portion 631. The fan 63F is an axial fan, a centrifugal fan, or the like. The heater 63H is, for example, a PTC (Positive Temperature Coefficient) heater, and heats the airflow generated by the fan 63F.

Figure 11:
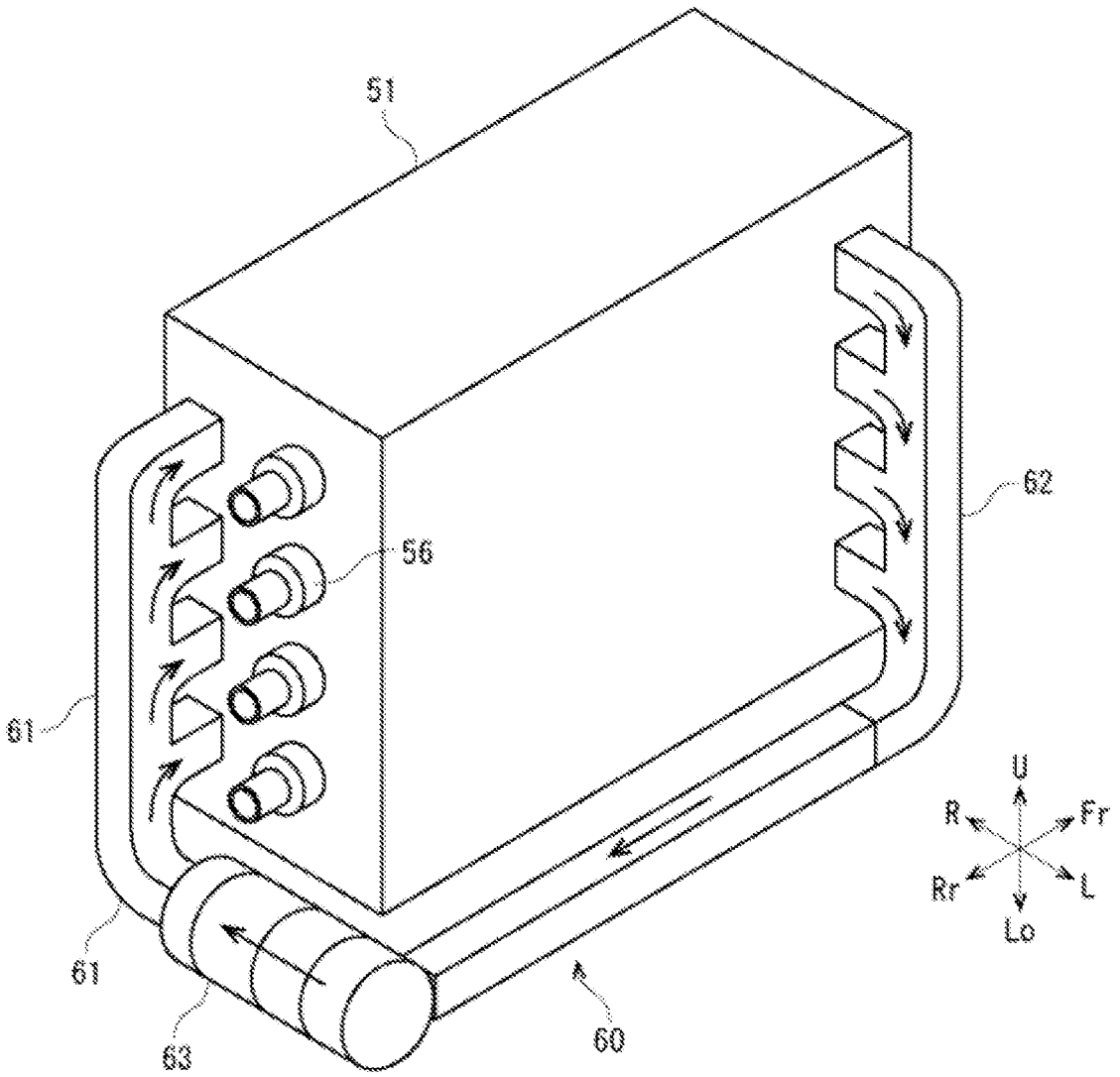
FIG. 11 is a perspective view illustrating a flow of warm air inside an ink heating device according to an embodiment of the present disclosure.
Figure 12:
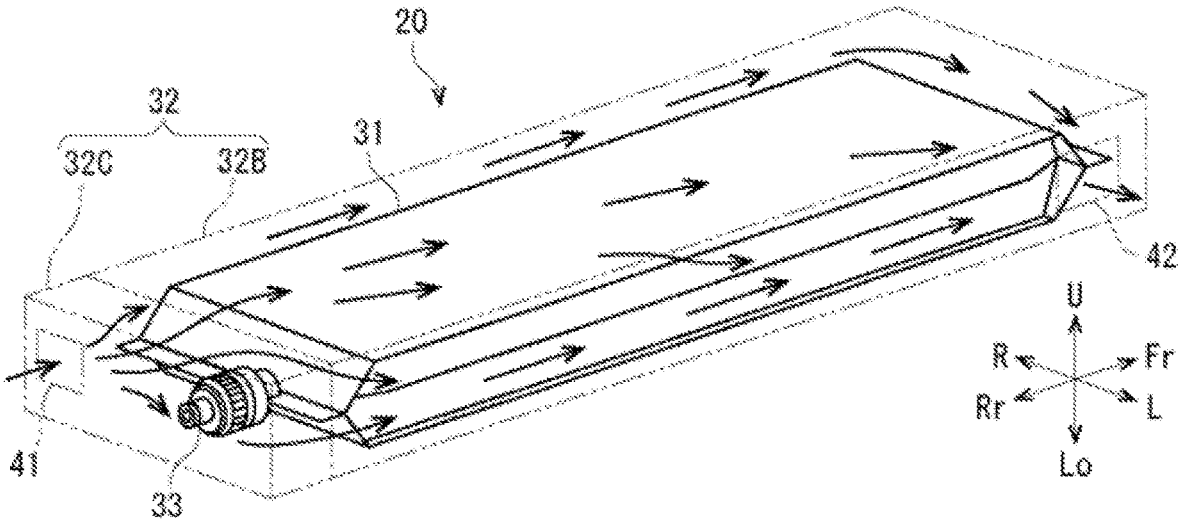
FIG. 12 is a perspective view illustrating a flow of warm air inside an ink container according to an embodiment of the present disclosure.

Next, the operation of the ink heating device 60 will be described. FIG. 11 is a perspective view showing the flow of warm air inside the ink heating device 60. FIG. 12 is a perspective view showing a flow of warm air inside the ink container 20.

The warm air generated by the blower 63 is supplied to each ink container 20 through the first duct 61. Inside the ink container 20, the warm air flowing in from the first opening 41 is discharged from the second opening 42 via spaces above, on the right side, on the left side, and on the front side of the ink pack 31 from the rear side of the ink pack 31. The discharged warm air passes through the second duct 62 and is collected by the blower 63.

According to the ink heating device 60 of the present embodiment described above, warm air is sent to the inside of the case 32 through the first opening 41, and the warm air is discharged through the second opening 42. According to this configuration, since heat is directly supplied to the ink pack 31 by warm air blowing against the ink pack 31, it is possible to efficiently heat ink compared to a configuration in which warm air blows against the outside of the case 32.

In addition, according to the ink heating device 60 according to the present embodiment, the second opening 42 is provided at a position deviated to the end portion side having a longer distance from the first opening 41 among both end portions of the second side surface when the case 32 is viewed from above. According to this configuration, since the deviation of the warm air inside the case 32 is reduced compared to a case in which the second opening 42 is provided at a position deviated to the end portion side having a shorter distance from the first opening 41, it is possible to efficiently apply heat to the entire ink pack 31.

In the ink heating device 60 according to the present embodiment, when the ink container 20 is mounted on the container mounting portion 51, the first opening 41 and the opening of the first duct 61 face each other. According to this configuration, since the work of connecting the first duct 61 to the first opening 41 is not necessary, an increase in the amount of work can be avoided. When warm air is supplied from the first duct 61, the warm air can be efficiently sent to the inside of the case 32. When the warm air is collected from the first duct 61, the heat of the warm air discharged from the first opening 41 is efficiently collected, so that power consumption can be suppressed.

In the ink heating device 60 according to the present embodiment, the first duct 61 guides warm air from the blower 63 to the container mounting portion 51.

According to this configuration, since a decrease in the temperature of the ink in the vicinity of the spout 33 is small, power consumption can be suppressed.

In the ink heating device 60 according to this embodiment, the second opening 42 is provided closer to the front side in the mounting direction of the case 32 than the first opening 41. According to this configuration, since the warm air smoothly flows between the first opening 41 and the second opening 42, a large amount of heat can be applied to the ink.

In the ink heating device 60 according to this embodiment, the second opening 42 is provided at the end portion on the front side in the mounting direction of the side surface along the mounting direction of the case 32, and when the ink container 20 is mounted on the container mounting portion 51, the second opening 42 and the opening of the second duct 62 face each other. According to this configuration, the second duct 62 does not interfere with the mounting of the ink container 20. In addition, since the work of connecting the second duct 62 to the second opening 42 is unnecessary, an increase in the amount of work can be avoided. Further, when the warm air is collected from the second duct 62, the heat of the warm air discharged from the second opening 42 is efficiently collected, so that power consumption can be suppressed. When warm air is supplied from the second duct 62, the warm air can be efficiently sent to the inside of the case 32.

In addition, according to the ink heating device 60 according to the present embodiment, the first opening 41 is provided at a position deviated to the opposite side of the side surface where the second opening 42 is provided on the end surface of the far side in the mounting direction of the case 32. According to this configuration, the deviation of the warm air inside the case 32 is reduced compared to a case in which the first opening 41 is provided on the same side as the side surface on which the second opening 42 is provided, and thus heat can be efficiently applied to the entire ink pack 31.

In the ink heating device 60 according to the present embodiment, the first duct 61 includes a branch pipe that guides warm air from the blower 63 to the plurality of ink containers 20. According to this configuration, it is possible to heat the plurality of ink containers 20 with one blower 63.

The above embodiment may be modified as follows.

Figure 13:
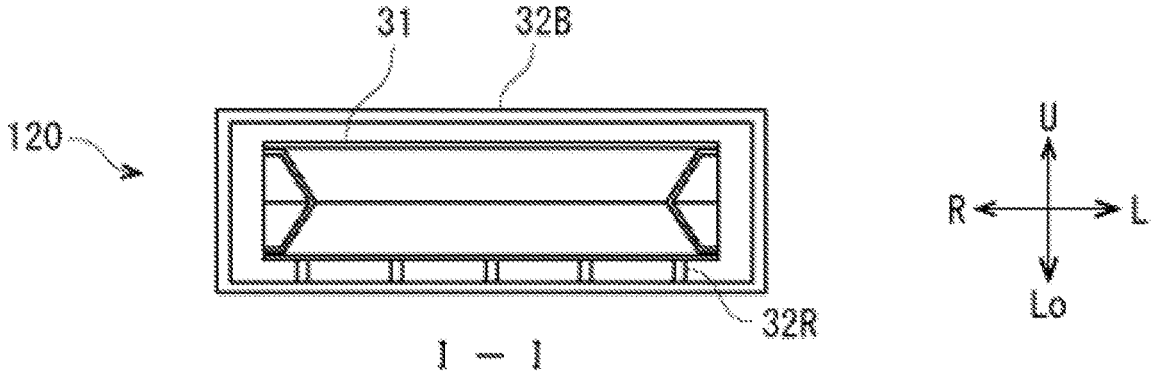
FIG. 13 is an I-I sectional view of an ink container according to a first modification of an embodiment of the present disclosure.

FIG. 13 is an I-I sectional view of an ink container 120 according to a first modification. In this example, in addition to the configuration of the above embodiment, a plurality of reinforcing ribs 32R whose longitudinal direction is the front-rear direction are provided on the upper surface of the bottom portion of the case 32. According to this configuration, since the warm air flows not only to the spaces behind, above, to the right of, to the left of, and to the front of the ink pack 31 but also to the space below the ink pack 31, the ink can be heated more efficiently than in the above-described embodiment.

In addition, instead of the reinforcing rib 32R described above, a plurality of reinforcing ribs 32R whose longitudinal direction is the direction of a straight line connecting the first opening 41 and the second opening 42 may be provided. According to this configuration, since warm air is guided from the first opening 41 to the second opening 42 by the reinforcing ribs 32R, it is possible to heat ink more efficiently than in the above-described modification.

Figure 14:
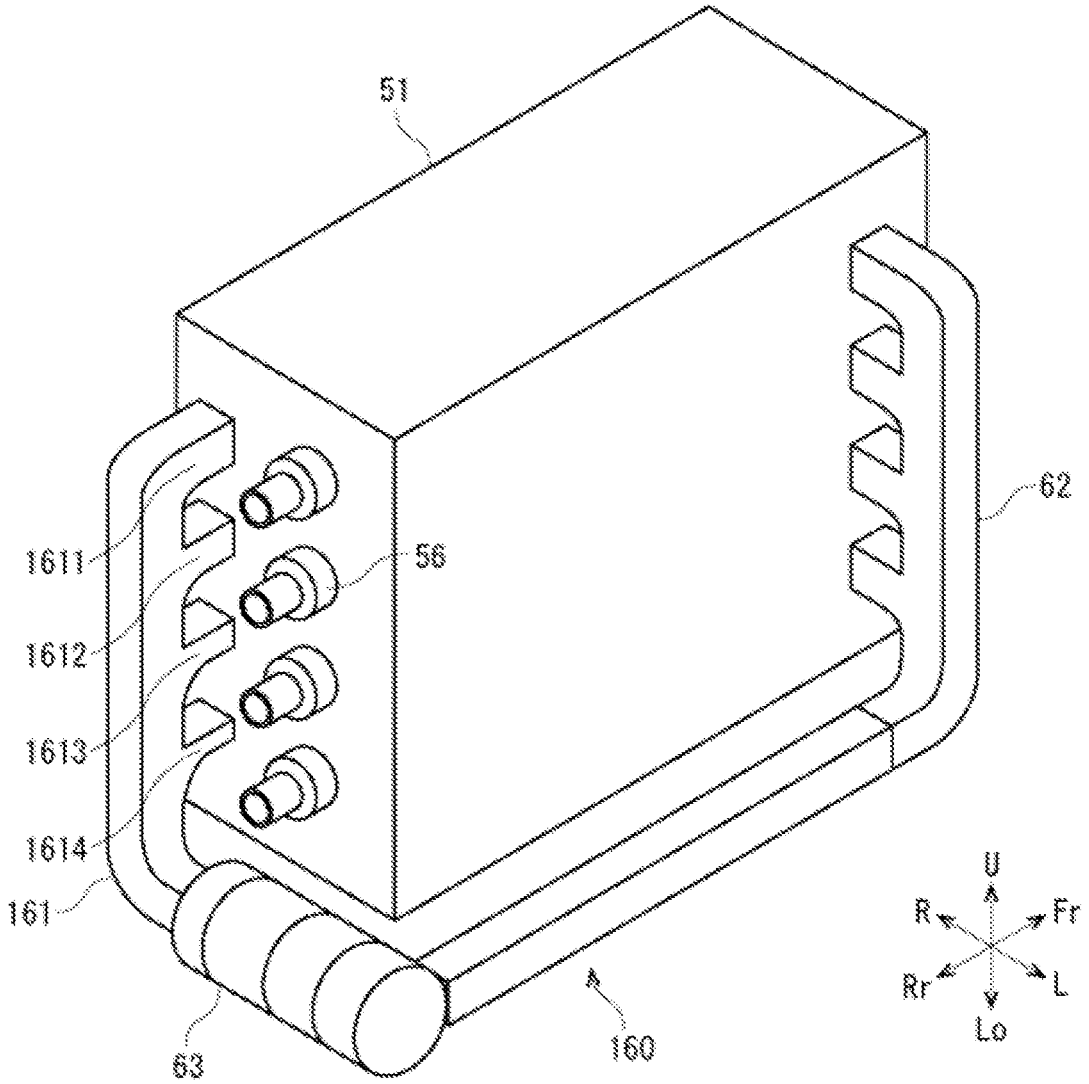
FIG. 14 is a perspective view of an ink heating device according to a second modification of an embodiment of the present disclosure.

FIG. 14 is a perspective view of an ink heating device 160 according to a second modification. In this example, as the distance from the blower 63 increases, the diameter of the pipe on the downstream side of the branch of the first duct 161 increases. That is, the pipe 1611 farthest from the blower 63 has the largest diameter, the pipe 1612 second farthest from the blower 63 has the second largest diameter, the pipe 1613 third farthest from the blower 63 has the third largest diameter, and the pipe 1614 closest to the blower 63 has the smallest diameter. As the distance from the blower 63 increases, the temperature of the warm air decreases. However, according to this configuration, since the air volume of the warm air increases as the distance from the blower 63 increases, it is possible to suppress the temperature difference of the warm air due to the distance from the blower 63.

Figure 15:
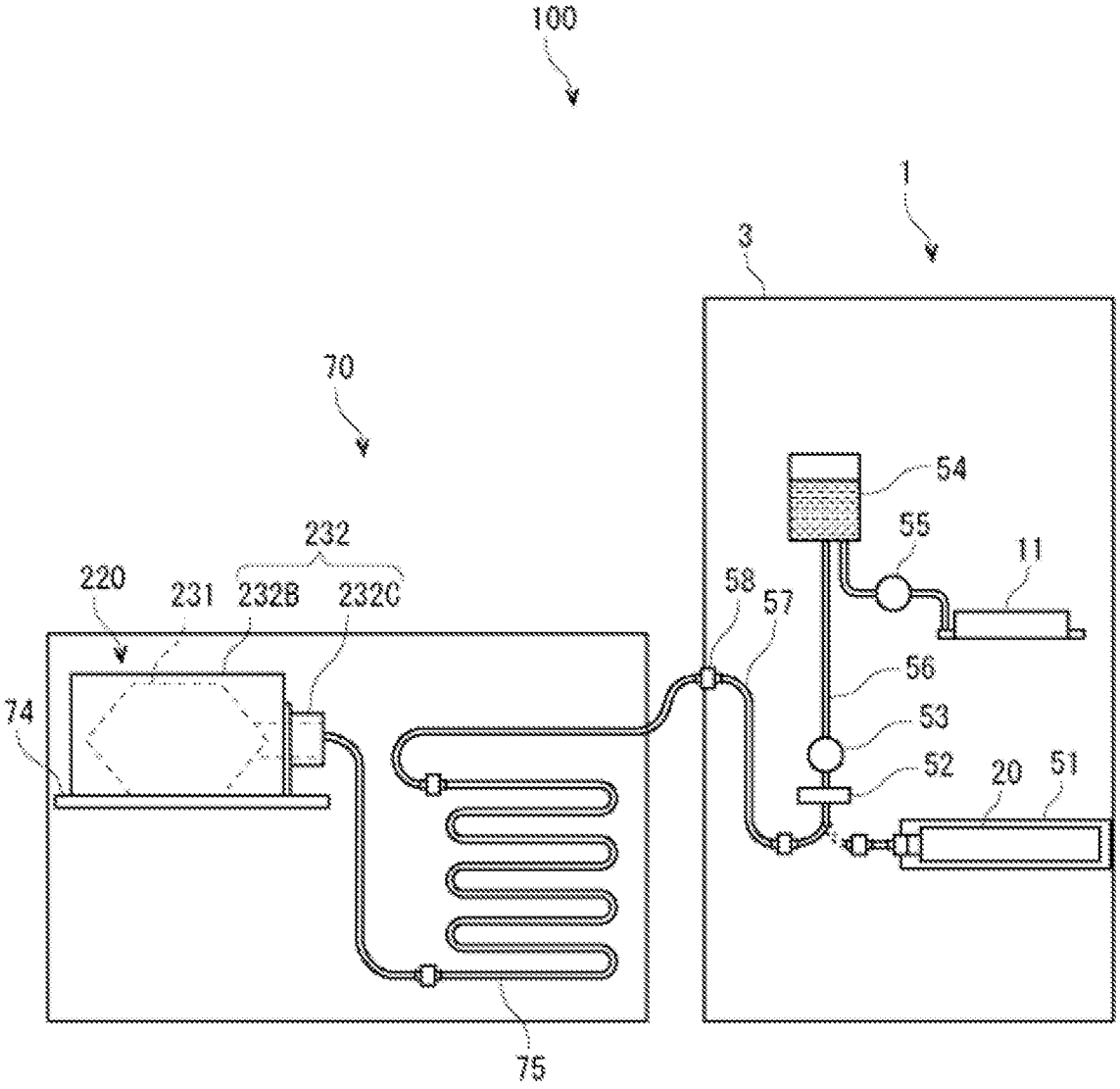
FIG. 15 is a diagram schematically illustrating an ink supply path of an image forming system 100 according to a third modification of an embodiment of the present disclosure.
Figure 16:
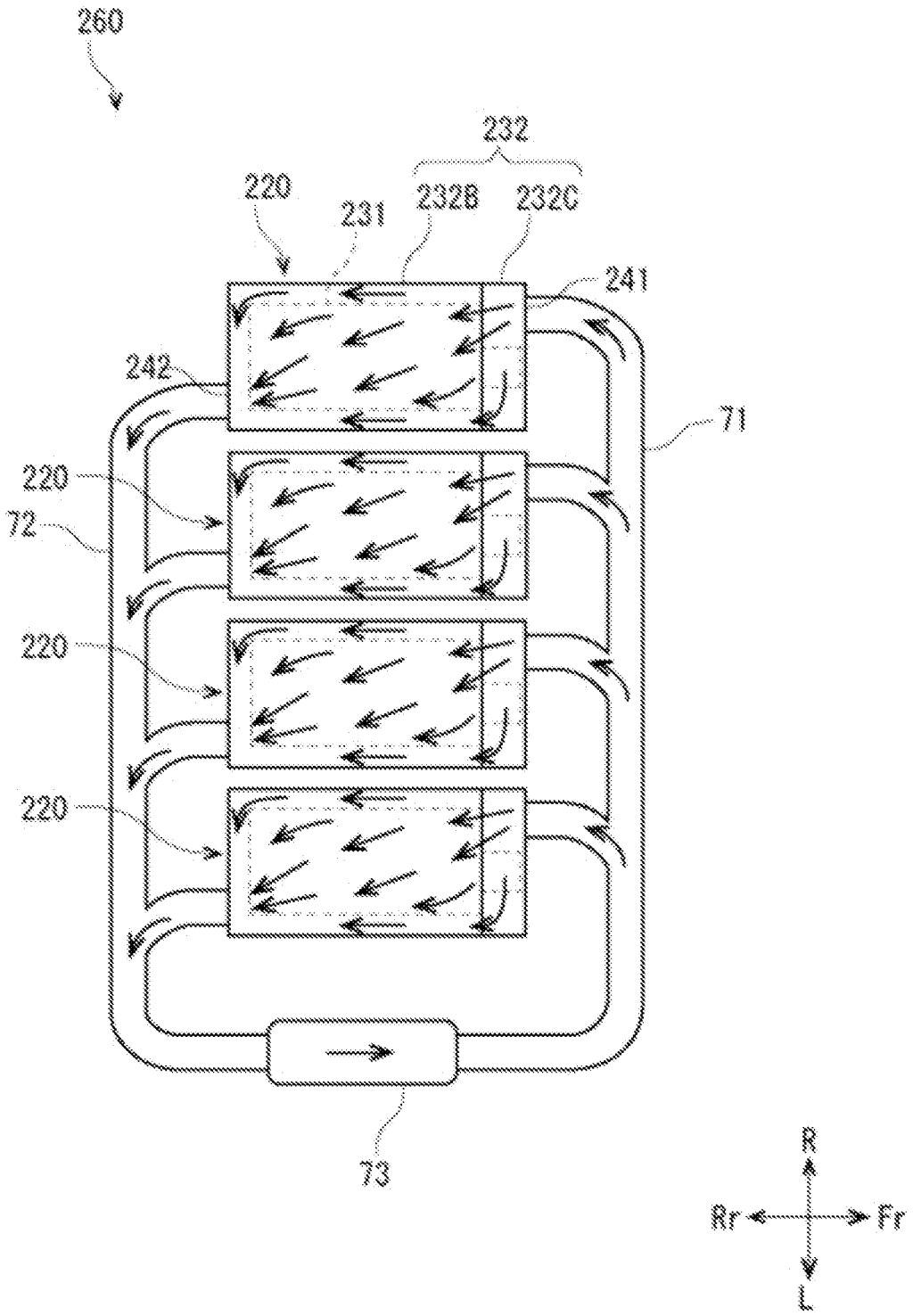
FIG. 16 is a plan view schematically illustrating an ink heating device according to the third modification of the embodiment of the present disclosure.

FIG. 15 is a diagram schematically illustrating an ink supply path of an image forming system 100 according to a third modification. FIG. 16 is a plan view schematically showing an ink heating device 260 according to the third modification. In the above-described embodiment, an example in which the present disclosure is applied to the printer 1 including the ink heating device 60 and the image forming unit 6 that forms an image by discharging ink supplied from the ink heating device 60 has been described. On the other hand, a third modification shows an example in which the present disclosure is applied to an ink supply apparatus 70 that includes an ink heating device 260 and supplies ink heated by the ink heating device 260. The third modification also shows an example in which the present disclosure is applied to an image forming system 100 including an ink supply apparatus 70 and a printer 1 that forms an image by discharging ink supplied from the ink supply apparatus 70.

In the printer 1, a main pipe 56 connects the ink container 20, the filter 52, the pump 53, and the sub tank 54 (refer to FIG. 15). A coupling 58 is provided on the back surface of the main body housing 3 of the printer 1, and one end portion of a relay pipe 57 is connected to the coupling 58. When the ink supply apparatus 70 is used, the upstream end portion of the main pipe 56 is replaced with the other end portion of the relay pipe 57 instead of the ink container 20. The ink supply apparatus 70 includes a container mounting portion 74 on which an ink container 220 is mounted, and a heater unit 75 that heats ink sent out from the ink container 220.

The ink container 220 has a larger capacity than the ink container 20 included in the printer 1. In this example, the plurality of ink containers 220 are arranged side by side in the left-right direction (see FIG. 16), but the plurality of ink containers 220 may be arranged in any manner. In this example, the ink container 220 is mounted to the container mounting portion 74 from above.

The ink container 220 includes an ink pack 231 filled with ink, and a case 232 that includes a first opening 241 and a second opening 242 and houses the ink pack 231. The case 232 includes a case main body portion 232B and a connecting portion 232C provided at a front end portion of the case main body portion 232B. The first opening 241 is provided at a left end portion of a rear surface of the case main body portion 232B. The second opening 242 is provided at a right end portion of a front surface of the connecting portion 232C.

The warm air generated by the blower 73 is supplied to each ink container 220 through the first duct 71. Inside the ink container 220, the warm air flowing in from the first opening 241 is discharged from the second opening 242 via spaces above, on the right side, on the left side, and on the rear side of the ink pack 231 from the front side of the ink pack 231. The discharged warm air is collected by the blower 73 via the second duct 72. In FIG. 16, the blower 73 is illustrated on the lateral side of the ink container 220 for convenience, but the blower 73 may be disposed below the ink container 220.

In the ink heating device 60 according to the third modification, the second opening 242 is provided at a position deviated to the end portion side having a longer distance from the first opening 241 among both end portions of the second side surface when the case 232 is viewed from above. According to this configuration, the deviation of the warm air inside the case 232 is reduced compared to a case in which the second opening 242 is provided at a position deviated to the end portion side having a shorter distance from the first opening 241, and thus it is possible to efficiently apply heat to the entire ink pack 231.

In the embodiment described above, an example is shown in which the ink heating device 60 includes the second duct 62. However, in a case in which warm air is sent from the first duct 61 to the ink container 20, the ink heating device 60 does not have to include the second duct 62. In this case, the position of the second opening 42 does not have to be the end portion on the front side in the mounting direction of the side surface along the mounting direction of the case 32. For example, the second opening 42 may be provided on an end surface of the case 32 on the front side in the mounting direction. In addition, in the above-described embodiment, an example in which the ink heating device 60 includes the first duct 61 has been described. However, in a case in which warm air is sent from the second duct 62 to the ink container 20, the ink heating device 60 does not have to include the first duct 61.

In the above-described embodiment, an example in which the second opening 42 faces the opening of the second duct 62 when the ink container 20 is mounted on the container mounting portion 51 has been described. However, in a case in which warm air is sent from the first duct 61 to the ink container 20, the second opening 42 does not have to face the opening of the second duct 62. In addition, in the above-described embodiment, an example in which the first opening 41 faces the opening of the first duct 61 when the ink container 20 is mounted on the container mounting portion 51 has been described. However, in a case in which warm air is sent from the second duct 62 to the ink container 20, the first opening 41 does not have to face the opening of the first duct 61.

What is claimed is:

1. An ink heating device comprising:

an ink container that includes an ink pack filled with ink and a case housing the ink pack and having a first opening and a second opening; and a blower that sends warm air into the case through one of the first opening and the second opening, wherein the warm air is discharged through the other of the first opening and the second opening.

2. The ink heating device according to claim 1, wherein when a virtual line having the longest length among virtual lines from the first opening to respective portions of the inner surface of the case is defined as a longest virtual line, when the case is divided into two parts of a first part and a second part on a virtual plane passing through a middle point of the longest virtual line and being orthogonal to the longest virtual line and when the first part is assumed to be where the first opening is disposed, the second opening is disposed in the second part.

3. The ink heating device according to claim 1, wherein the case is formed in a shape of a rectangular parallelepiped, the first opening is provided on a first side surface among four side surfaces of the case, the second opening is provided on a second side surface among the four side surfaces of the case, and when the case is viewed from above, the second side surface has two end portions, and the second opening is provided at a position closer to the end portion having a longer distance to the first opening along an outer shape of the case than the end portion having a shorter distance to the first opening along the outer shape of the case.

4. The ink heating device according to claim 1, comprising a container mounting portion to which the ink container is attached, wherein the container mounting portion includes a first duct connected to the blower, the ink pack includes a spout that supplies the ink to outside at an end portion of the ink container on a far side in a mounting direction of the ink container to the container mounting portion, the case includes a third opening for fixing the spout and the first opening on an end surface on a far side in the mounting direction, and the first opening and the opening of the first duct face each other when the ink container is mounted on the container mounting portion.

5. The ink heating device according to claim 4, wherein the first duct guides the warm air from the blower to the container mounting portion.

6. The ink heating device according to claim 4, wherein the second opening is provided closer to a front side in the mounting direction of the case than the first opening.

7. The ink heating device according to claim 4, wherein the container mounting portion includes a second duct connected to the blower, the case is formed in a rectangular parallelepiped shape whose longitudinal direction is the mounting direction, the second opening is provided at an end portion on the front side in the mounting direction of a side surface along the mounting direction of the case, and in the container mounting portion, the second opening and an opening of the second duct face each other when the ink container is mounted on the container mounting portion.

8. The ink heating device according to claim 7, wherein the first opening is provided at a position deviated to an opposite side of a side surface where the second opening is provided on an end surface of the case on a far side in the mounting direction.

9. The ink heating device according to claim 4, comprising a plurality of sets of the ink containers and the container mounting portions, and the first duct includes a branch pipe connected from the blower to the plurality of ink containers.

10. An inkjet recording apparatus comprising:

the ink heating device according to claim 1; and an image forming unit forming an image by discharging the ink supplied from the ink heating device.

11. An ink supply apparatus comprising the ink heating device according to claim 1, wherein the ink heated by the ink heating device is supplied.

12. An image forming system comprising:

the ink supply apparatus according to claim 11; and an inkjet recording apparatus forming an image by discharging the ink supplied from the ink supply apparatus.

* * * * *